US010280885B2

(12) United States Patent
Sumida

(10) Patent No.: US 10,280,885 B2
(45) Date of Patent: May 7, 2019

(54) FLUID INJECTION VALVE AND SPRAY GENERATOR

(71) Applicant: MITSUBISHI ELECTRIC CORPORATION, Chiyoda-ku, Tokyo (JP)

(72) Inventor: Mamoru Sumida, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 1013 days.

(21) Appl. No.: 14/082,925

(22) Filed: Nov. 18, 2013

(65) Prior Publication Data

US 2014/0158090 A1 Jun. 12, 2014

(30) Foreign Application Priority Data

Dec. 11, 2012 (JP) ..... 2012-270493

(51) Int. Cl.
*F02M 61/04* (2006.01)
*F02M 61/16* (2006.01)
*F02M 61/18* (2006.01)

(52) U.S. Cl.
CPC ..... *F02M 61/04* (2013.01); *F02M 61/162* (2013.01); *F02M 61/1853* (2013.01)

(58) Field of Classification Search
CPC .. F02M 61/04; F02M 61/162; F02M 61/1853; F02M 61/1813; F02M 51/0675;
(Continued)

(56) References Cited

U.S. PATENT DOCUMENTS 4,513,720 A * 4/1985 Takeda ..... F02M 69/043 123/470
5,143,295 A * 9/1992 Okayama ..... B05B 1/34 239/403

(Continued)

FOREIGN PATENT DOCUMENTS

DE 4115477 A1 * 11/1991 ..... F02M 45/086
JP 2000-104647 A 4/2000

(Continued)

OTHER PUBLICATIONS

ILASS-Europe 2010 An experimental investigation of discharge coefficient and cavitation length in the elliptical nozzles (Sung Ryoul Kim).*

*Primary Examiner* — Stephen K Cronin
*Assistant Examiner* — Carl C Staubach
(74) *Attorney, Agent, or Firm* — Sughrue Mion, PLLC; Richard C. Turner

(57) ABSTRACT

Provided is a fuel injection valve which achieves both atomization of a fluid spray and improvement of the degree of freedom in design of a spray shape, a spray direction, etc. According to a fuel injection valve (1) of the present invention, at least one of injection holes is a switching-spray injection hole (12B), which corresponds to an injected spray, directions of a long axis and a short axis of a switching spray (32A) changing due to an axis-switching phenomenon to deform the switching spray (32A) at downstream. The plurality of injection holes other than the switching-spray injection hole (12B) are coalescent-spray injection holes (12A) for forming a coalescent spray (40) formed by coalescence under Coanda effect exerted between single sprays (30A, 31A). The coalescent spray (40) and the switching spray (32A) coalesce under the Coanda effect to form an integrated spray (50).

12 Claims, 11 Drawing Sheets

(58) Field of Classification Search
CPC ..... F02M 61/18; F02M 61/1806; B05B 1/34; B05B 7/10
USPC ..... 123/445; 239/552
See application file for complete search history.

(56) References Cited

U.S. PATENT DOCUMENTS 6,311,899 B1 * 11/2001 Hidaka ..... B05B 7/0861 239/290
6,669,106 B2 * 12/2003 Delcea ..... C23C 4/12 219/121.5
6,708,904 B2 * 3/2004 Itatsu ..... F02M 61/1846 239/533.12
6,994,279 B2 * 2/2006 Saito ..... F02M 51/0671 239/533.12
7,093,776 B2 * 8/2006 Schneider ..... F02M 61/186 239/494
8,002,207 B2 8/2011 Hashii et al.
9,739,247 B2 * 8/2017 Sumida ..... F02M 61/184
2008/0116301 A1 * 5/2008 Yasukawa ..... F02M 61/18 239/533.12
2009/0065609 A1 * 3/2009 Suzuki ..... F02M 61/1813 239/265.27
2009/0222197 A1 * 9/2009 Moriya ..... F01L 1/344 701/105
2010/0090031 A1 4/2010 Hashii et al.
2010/0237174 A1 * 9/2010 Oomori ..... F02B 23/104 239/533.12
2012/0325922 A1 * 12/2012 Sumida ..... F02M 61/1806 239/1
2013/0099015 A1 * 4/2013 Sumida ..... F02M 61/184 239/1
2014/0158090 A1 * 6/2014 Sumida ..... F02M 61/04 123/445

FOREIGN PATENT DOCUMENTS

JP 2005-207236 A 8/2005
JP 2011202513 A * 10/2011
WO 2008/093387 A1 8/2008
WO 2008/117459 A1 10/2008

* cited by examiner

FLUID INJECTION VALVE AND SPRAY GENERATOR

BACKGROUND OF THE INVENTION

1. Field of the Invention

The present invention relates to a fluid injection valve, which is configured to inject jets respectively from a plurality of injection holes to form sprays at downstream, which ultimately coalesce to form a solid integrated spray, and a spray generator using the fluid injection valve.

2. Description of the Related Art

In recent years, for vehicle engines for automobiles and the like, research and development have been actively carried out to reduce an exhaust gas at the time of engine cooling and to improve combustibility by atomizing a fuel spray and the like so as to improve fuel efficiency.

For example, the following fuel injection valve is known. Specifically, an atomized spray obtained by collision and a lead spray with a large penetration force are formed. The lead spray leads the atomized spray to suppress the scatter of the spray. In this manner, a portion of the spray, which has a higher fuel spray density, is present on the inner side of a center position of each intake valve, specifically, between the center positions of the intake valves (see Japanese Patent Application Laid-open No. 2005-207236).

The following fuel injection valve is also known. Specifically, the sprays are atomized while the interference between the sprays is avoided. In addition, the sprays flow forward while being attracted to each other under the Coanda effect. Therefore, a deviation of a flow direction of each of the sprays can be prevented (see Japanese Patent Application Laid-open No. 2000-104647).

SUMMARY OF THE INVENTION

In the fuel injection valve described in Japanese Patent Application Laid-open No. 2005-207236, however, a distance from the injection hole to the position of collision is required to be set shorter than a breakup length of each of the jets in order to atomize the jets by the collision. In this case, the jets (sprays) are scattered because of the atomization. Moreover, a significant amount of energy of the jets is converted by the collision into a surface tension of scattered sprayed particles. Therefore, the penetration force is lowered.

Thus, even when the spray with the lowered penetration force, which is scatted by the collision, is led by the lead spray with the large penetration force, which is injected simultaneously with the spray with the lowered penetration force, the timings of behaviors of distal end portions of the sprays do not coincide with each other. Therefore, in the case of a small spray amount with a short injection time period, the lead spray alone moves forward while the spray scatted by the collision is left.

At the same time, besides induced vortices illustrated in FIG. 4 of Japanese Patent Application Laid-open No. 2005-207236, an inducted vortex generated by the lead spray forms a vortex ring around an outer circumference of the lead spray at downstream in a certain injection direction determined by the balance in shear force between the outer circumference of the lead spray and an atmosphere. Therefore, the scattered spray is introduced into the vortex ring, and thus cannot further move to the downstream side in the injection direction.

As described above, for the forward flow of the lead spray while leading the scattered atomized spray, various constraint conditions are required. Therefore, the fuel injection valve described in Japanese Patent Application Laid-open No. 2005-207236 is not suitable for an injection system for a gasoline engine, which is often placed in an unsteady state during a transient operation. Accordingly, a technique for more simply improving the degree of freedom in design of a spray pattern and a shape of the integrated spray is desired.

Further, with the fuel injection valve described in Japanese Patent Application Laid-open No. 2000-104647, it is difficult to maintain the balance between the spray directions even under a static atmosphere condition, where the Coanda effect is exerted to prevent each of the sprays from being too widened and the Coanda effect is suppressed to prevent the sprays from coalescing. Moreover, inside an intake port, the sprays are also affected by ambient pressure and temperature, an intake-air flux, a spray volume (weight) flow rate, and a spraying speed. Therefore, it is extremely difficult to realize the maintenance of the balance of the spray directions in the injection system for a gasoline engine, which is often placed in the unsteady state during the transient operation.

Specifically, the Coanda effect described in Japanese Patent Application No. 2000-104647 is not utilized to intentionally form a compact assembled spray. Thus, the spray shape and the spray pattern of the integrated spray, and an injection-amount distribution in the integrated spray are not particularly set.

As described above, the fuel injection valves described in Japanese Patent Application Laid-open Nos. 2005-207236 and 2000-104647 cited above have the following problem. Specifically, Japanese Patent Application Laid-open Nos. 2005-207236 and 2000-104647 do not describe any measures to achieve both the improvement of atomization of the sprays and the improvement of the degree of freedom in design of the spray shape, the spray pattern, the penetration force of the spray, and the injection-amount distribution, and therefore do not provide any guidelines for the determination of optimal spray specifications under current conditions where the shape of the intake port or the intake-air flux is different for each engine specification.

The present invention has been made to solve the problem described above, and therefore has an object to provide a fluid injection valve which achieves both atomization of a fluid spray and improvement of the degree of freedom in design of a spray shape, a penetration force, an injection-amount distribution, and a spray direction, and a spray generator using the fluid injection valve.

According to one embodiment of the present invention, there is provided a fluid injection valve, including:

a valve seat provided in a midway of a fluid passage;

a valve element configured to come into contact with and be separated away from the valve seat to control opening and closure of the fluid passage; and an injection-hole body including a plurality of injection holes, provided downstream of the valve seat, the fluid injection valve being configured to inject jets respectively from the plurality of injection holes to form sprays at downstream, the sprays ultimately coalescing to form a solid integrated spray, in which:

at least one of the plurality of injection holes is a switching-spray injection hole for injecting a switching spray having different lengths of a long axis and a short axis on a plane perpendicular to a flow direction, which corresponds to the spray after the injection of the jet, directions of the long axis and the short axis of a cross section of the switching spray changing due to an axis-switching phenomenon to deform the switching spray at downstream;

the plurality of injection holes other than the switching-spray injection hole are coalescent-spray injection holes for forming a coalescent spray formed by coalescence of single sprays under Coanda effect exerted between the single sprays on a downstream side of a breakup position at which the respective jets break up into the single sprays after rupture and breakup; and the coalescent spray before any one of a center and a gravity center of an injection-amount distribution of each of the coalesced single sprays converges to any one of a center and a gravity center of the coalescent spray and the switching spray coalesce under the Coanda effect to form an integrated spray.

According to the fluid injection valve of the present invention, the coalescent spray before the center or the gravity center of the injection-amount distribution of each of the coalesced single sprays converges to the center or the gravity center of the coalescent spray, and the switching spray coalesce under the Coanda effect to form the integrated spray. In this manner, the atomization of the fluid spray and the improvement of the degree of freedom in design of a spray shape, a penetration force, an injection-amount distribution, and a spray direction can be both achieved.

DETAILED DESCRIPTION OF THE PREFERRED EMBODIMENTS

Figure 1:
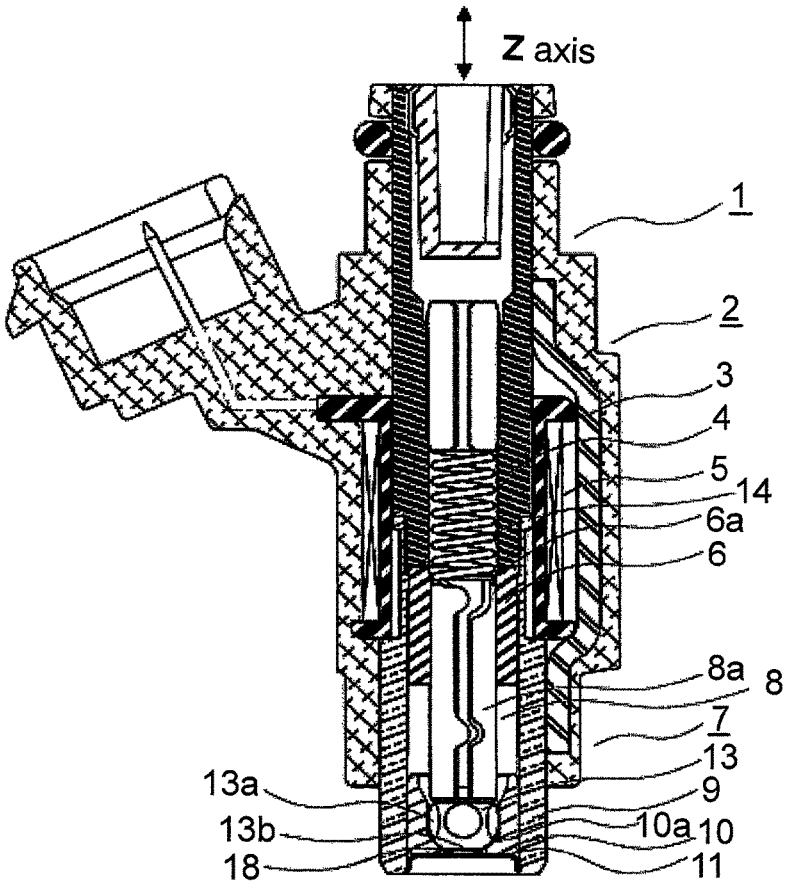
FIG. 1 is a sectional view illustrating a fuel injection valve according to a first embodiment of the present invention.

Referring to the accompanying drawings, embodiments of the present invention are described below. In the drawings, the same or corresponding components and parts are denoted by the same reference symbols.

First Embodiment

Figure 2:
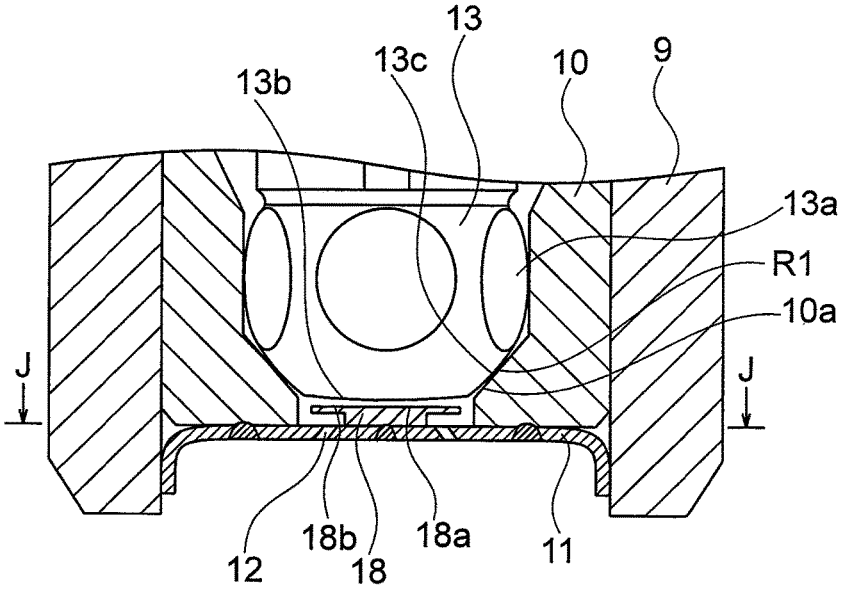
FIG. 2 is an enlarged view illustrating a distal end portion of the fuel injection valve illustrated in FIG. 1.

FIG. 1 is a sectional view illustrating a fuel injection valve 1, and FIG. 2 is an enlarged view illustrating a distal end portion of the fuel injection valve 1 illustrated in FIG. 1.

The fuel injection valve 1 is mounted to an intake pipe of an internal combustion engine. The distal end portion of the fuel injection valve 1 is located inside an intake port of an internal combustion engine. The fuel injection valve 1 injects a fuel downward.

The fuel injection valve 1 includes a solenoid device 2 and a valve device 7. The solenoid device 2 generates an electromagnetic force. The valve device 7 is actuated by energization of the solenoid device 2.

The solenoid device 2 includes a housing 3, a core 4, a coil 5, and an armature 6. The housing 3 forms a yoke portion of a magnetic circuit. The core 4 is a fixed core provided inside the housing 3. The coil 5 surrounds the core 4. The armature 6 is a movable core provided inside the coil 5, which moves in a reciprocating manner.

The valve device 7 includes a valve main body 9, a valve seat 10, an injection-hole plate 11, a cover plate 18, and a valve element 8, and a compression spring 14. The valve main body 9 has a cylindrical shape, and is pressed over and welded to an outer diameter portion of a distal end portion of the core 4. The valve seat 10 is provided inside the valve main body 9. The injection-hole plate 11 is provided on the downstream side of the valve seat 10. The cover plate 18 is provided inside the valve seat 10 upstream of the injection-hole plate 11. The valve element 8 is provided on the inner side of the valve main body 9. The compression spring 14 is provided upstream of the valve element 8.

The valve element 8 includes a rod 8*a* and a ball 13. The rod 8*a* is hollow, and is pressed into and welded to the armature 6 so as to be held in contact with an inner surface of the armature 6. The ball 13 is fixed to a distal end portion of the rod 8*a* by welding.

The ball 13 includes chamfered portions 13*a*, a plane portion 13*b*, and a curved portion 13*c*. The chamfered portions 13*a* are parallel to a Z axis of the fuel injection valve 1. The plane portion 13*b* having a planar shape is opposed to the cover plate 18. The curved portion 13*c* is held in line contact with the valve seat 10.

A circumferential edge portion of the injection-hole plate 11 is bent downward so as to be welded to a distal end surface of the valve seat 10 and an inner circumferential side surface of the valve main body 9. A plurality of injection holes 12A for sprays to coalesce (hereinafter referred to simply as "coalescent-spray injection holes 12A") and a plurality of injection holes 12B for switching sprays (hereinafter referred to simply as "switching-spray injection holes 12B"), which pass through a plate thickness direction, are formed through the injection-hole plate 11.

Figure 3:
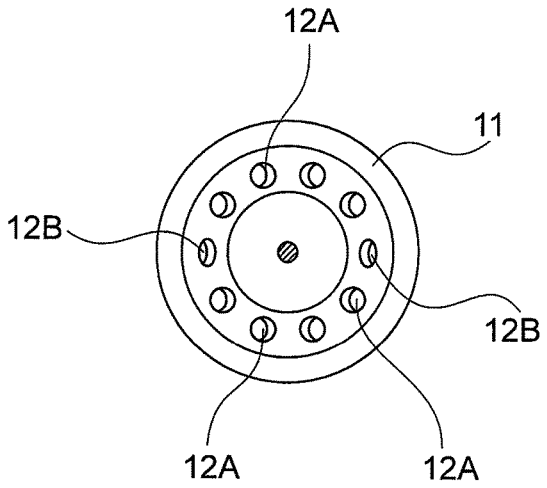
FIG. 3 is a plan view illustrating an injection-hole plate illustrated in FIG. 2.

FIG. 3 is a plan view of the injection-hole plate 11 as viewed from a direction indicated the arrows J shown in FIG. 2.

The coalescent-spray injection holes 12A and the switching-spray injection holes 12B, which are oriented downward along the Z axis which is a central axis of the fuel injection valve 1, are provided equiangularly to the injection-hole plate 11.

The coalescent-spray injection holes 12A and the switching-spray injection holes 12B are divided into two injection-hole groups. In the respective injection-hole groups, central axis lines of the coalescent-spray injection holes 12A and the switching-spray injection holes 12B, that is, directions of jets are oriented to intake valves of the engine, and are in two directions crossing each other in a horizontal direction in FIG. 3.

The switching-spray injection holes 12B, each having an oval cross section, are opposed to each other. On both side of each of the switching-spray injection holes 12B, the plurality of coalescent-spray injection holes 12A, each having a circular cross section, are provided.

Next, an operation of the fuel injection valve 1 is described.

When an operation signal is transmitted to a driving circuit for the fuel injection valve 1 by a controller (not shown) of the internal combustion engine, a current starts flowing through the coil 5 of the fuel injection valve 1 to attract the armature 6 toward the core 4.

As a result, the rod 8*a* and the ball 13 which have a structure integral with the armature 6 move upward against an elastic force of the compression spring 14. Then, the curved portion 13*c* of the ball 13 is separated away from a valve seat surface 10*a* to form a gap therebetween, which becomes a fuel channel. Then, the fuel injection toward the intake port is started.

On the other hand, an operation stop signal is transmitted to the driving circuit for the fuel injection valve 1 by the controller of the internal combustion engine, the energization of the coil 5 is stopped. Then, the force for attracting the armature 6 toward the core 4 disappears. The rod 8*a* is pressed toward the valve seat 10 by the elastic force of the compression spring 14. As a result, the curved portion 13*c* and the valve seat surface 10*a* are brought into contact with each other to close the gap. At this time, the fuel injection is terminated.

Figure 4:
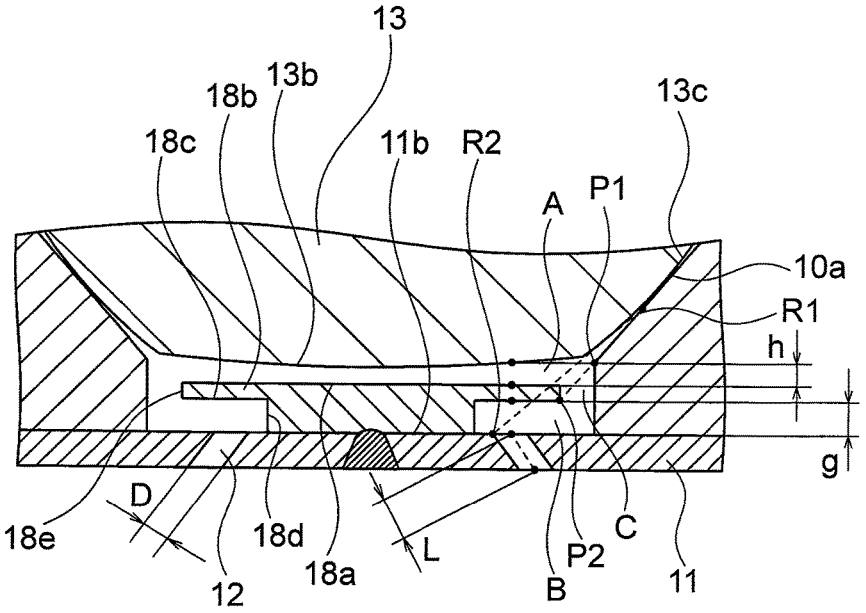
FIG. 4 is an enlarged view illustrating the distal end portion of the fuel injection valve illustrated in FIG. 1.
Figure 5:
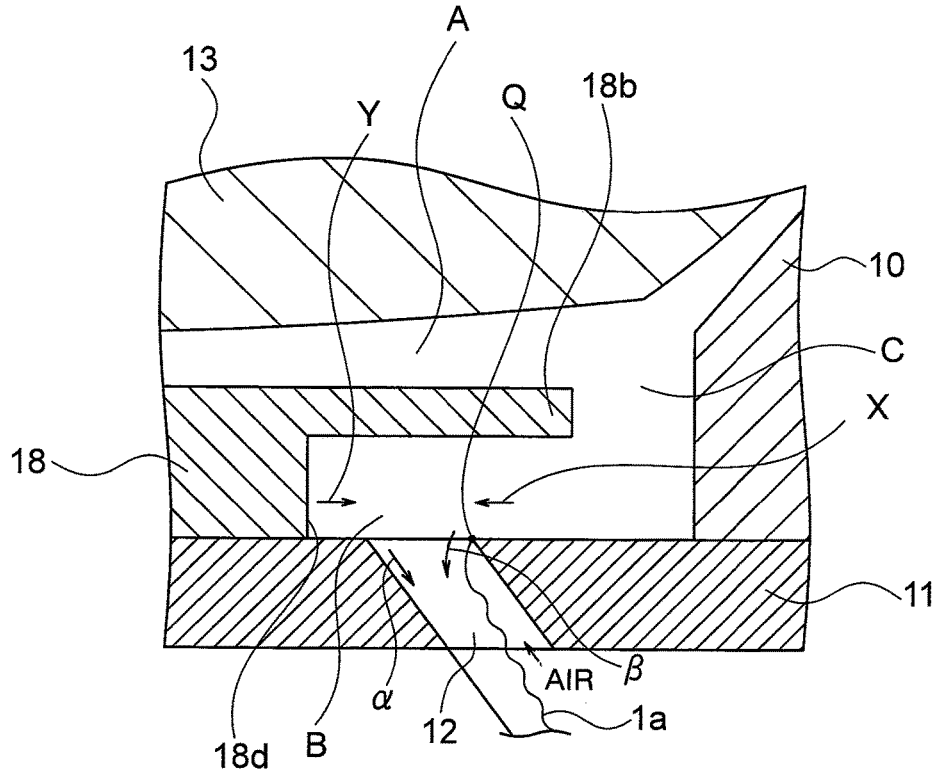
FIG. 5 is an enlarged view illustrating a principal part of FIG. 2.

Specific positions and structures of the injection-hole plate 11, the cover plate 18, the valve seat 10, and the ball 13, which form flows through coalescent-spray injection holes 12A and the switching-spray injection holes 12B by, for example, contracted flows into liquid film flows, are described referring to specific sectional views of FIGS. 2, 4, and 5.

When the valve element 8 is open, the fuel passes through the passages between the chamfered portions 13*a* of the ball 13 and the inner surface of the valve seat 10, which are parallel to the Z axis, to flow between the curved portion 13*c* and the valve seat portion 10*a* toward the downstream side to reach a seat portion R1.

At upstream of the seat portion R1, the fuel flows in parallel to the Z axis. Therefore, a flow of the fuel along the valve seat surface 10*a* by inertia becomes a main flow after passing through the seat portion R1. Then, the fuel reaches a point P1 at a downstream end of the valve seat surface 10*a*. The point P1 is a terminal end of the valve seat surface 10*a*. The valve seat 10 has a surface extending in a vertical direction from the point P1 to the downstream side.

Therefore, the main flow of the fuel is separated away from the point P1. An extended line of the valve seat surface 10*a* crosses a circumferential side surface of the cover plate 18 at a point P2. The fuel separated away from the point P1 flows toward the point P2 to pass through an annular passage C (between an inner circumferential wall surface of the valve seat 10 and a circumferential side surface of a large-diameter portion of the cover plate 18), and then flows into a radial passage B (between the inner circumferential wall surface of the valve seat 10 and a circumferential side surface of a small-diameter portion of the cover plate 18) without greatly changing the direction of flow in the radial direction.

As described above, the main flow of the fuel passing through the seat portion R1 flows into the annular passage C. Therefore, the flow into a gap passage A (between a bottom surface of the ball 13 and a top surface of the cover plate 18) is suppressed.

A straight line connecting the seat portion R1 and a point R2 at an inlet of each of the injection holes 12 crosses to each other at a thin portion 18*b* which is the large-diameter portion of the cover plate 18. The thin portion 18*b* blocks the linear flow of the fuel from the seat portion R1 to the inlet of each of the injection holes 12.

Therefore, at least a part of the fuel flowing into the coalescent-spray injection holes 12A and the switching-spray injection holes 12B flows along the radial passage B. The cover plate 18 is provided so that the terminal end surface 18*d* is located in proximity to the injection holes 12 on the inner-diameter side of the injection holes 12. Therefore, a forward flow X (see FIG. 5) of the fuel flowing toward the inner-diameter side along the radial passage B closes a flow channel of a return flow Y flowing from the side of the Z axis (center) of the fuel injection valve 1 to the injection holes 12. In this manner, a speed of the return flow Y is lowered.

As a result of the suppression of the return flow Y, a speed of the forward flow X flowing from the seat portion R1 side into the injection holes 12 is relatively increased.

The direction of flow inside the coalescent-spray injection holes 12A and the switching-spray injection holes 12B is forced to be significantly changed after at least a part of the forward flow X moves forward along the radial passage B, and the speed of the front flow X is high. Therefore, the fuel is strongly pressed against wall surfaces of the coalescent-spray injection holes 12A and the switching-spray injection holes 12B on the Z-axis side of the fuel injection valve 1, as viewed on the cross sections of the injection holes 12.

In FIG. 4, the reference symbol L denotes a length of each of the coalescent-spray injection holes 12A and the switching-spray injection holes 12B, and the reference symbol D denotes a diameter of each of the coalescent-spray injection holes 12A and the switching-spray injection holes 12B.

Thereafter, at the inlet of each of the coalescent-spray injection holes 12A and the switching-spray injection holes 12B, the return flow Y at a low speed forms a flow a along the wall surface of each of the injection holes 12. On the other hand, the forward flow X at a high speed forms a fuel flow β in which the fuel is pressed against the wall surface of each of the injection holes 12.

Air is introduced from each of outlets of the coalescent-spray injection holes 12A and the switching-spray injection holes 12B to the vicinity of each of the inlets of the coalescent-spray injection holes 12A and the switching-spray injection holes 12B to act on the fuel flow β, thereby separating the fuel flow β away from the wall surface of the corresponding one of the coalescent-spray injection holes 12A and the switching-spray injection holes 12B with a point Q (an outer edge portion of the inlet of each of the injection holes 12 for the fuel) as a point of origin.

The fuel flow β is pressed against the wall surface as moving forward through the corresponding one of the coalescent-spray injection holes 12A and the switching-spray injection holes 12B. A direction of the liquid film changes to a direction along the wall surface of each of the coalescent-spray injection holes 12A and the switching-spray injection holes 12B while spreading in a circumferential direction of the wall surface of each of the coalescent-spray injection holes 12A and the switching-spray injection holes 12B.

When the length L of each of the coalescent-spray injection holes 12A and the switching-spray injection holes 12B is appropriate with respect to a height h of the gap passage A, the fuel flow β is pressed until a state of a thin liquid film flow 1*a* is achieved inside the corresponding one of the coalescent-spray injection holes 12A and the switching-spray injection holes 12B.

Then, the liquid film flow 1*a* of the injected fuel starts breaking up after passing over a predetermined distance. After each of the liquid film flows obtained by the breakup is placed in a ligament state, atomized droplets are generated.

In a process of the atomization, it is effective to thin the ligaments, which correspond to a state prior to the breakup, so as to obtain small droplets. In order to thin the ligaments, it is effective to reduce a thickness of the liquid film or thin liquid columns which correspond to a state prior to the ligament breakup. Further, it is found based on conventional knowledge that the formation of liquid films is more effective than the formation of the liquid columns.

Besides, various liquid film flow formation techniques including applying a swirl flow to the fuel flow before flowing into the injection holes to form the liquid film flows inside the injection holes have been proposed.

As a result of research and examination on a quality relationship between the above-mentioned liquid film flow formation techniques and the atomization process, and a spray shape, a penetration force, and an injection-amount distribution of a coalescent spray formed by coalescence of the plurality of sprays based on the above-mentioned techniques and the atomization process, the inventor of the present invention has found that the coalescent spray obtained by coalescence of single sprays can be classified into the following two forms.

Specifically, in one form of the coalescent spray, each of the single sprays can be identified and a characteristic of each of the single sprays cannot be substantially identified (specifically, the coalescent spray has a solid structure, which is relatively nearly uniform). In the other form of the coalescent spray, even each of the single sprays cannot be identified (specifically, in a representative example of the coalescent spray, the injection-amount distribution has a conical shape having a peak at the center).

In the latter form of the coalescent spray, the plurality of single sprays coalesce to become a new single coalescent spray which is substantially different from the original form. Moreover, even the former form of the coalescent spray exhibits characteristics common to the coalescent spray even though each of the single sprays can be identified.

In which of the above-mentioned forms the coalescent spray becomes depends on which side of a certain threshold value a spray behavior is located. As the degree of coalescence of the single sprays becomes higher in the coalescent spray, the injection-amount distribution becomes closer to axial symmetry and has a conical shape having an acute angle.

Therefore, even in the case of the former form of the coalescent spray, the spray shape and the injection-amount distribution in a plane perpendicular to the spray direction becomes approximately axially symmetric. Thus, it is conventionally difficult to form a sectional shape of the spray shape into a so-called "irregular shape".

For the above-mentioned fact, setting of spray targeting (injection position, injection direction, and spray specifications) for suppressing adhesion to the intake port and the vicinity of the intake valve which have irregular passage sectional shapes over almost the entire passage is insufficient.

Various atomization techniques as described above are more and more applied to the fuel injection valve. The above-mentioned techniques are originally on the stream of a technology of reducing a diameter of the injection hole and increasing the number of injection holes for the atomization. Attention is paid to prevent the jets injected from the adjacent injection holes from interfering each other so as not to degrade an atomized state.

Specifically, the arrangement of the injection holes and injection-hole data (such as a diameter, an inclination, and a length) or the arrangement of the jets and the directions of the jets are determined so that the central axis lines of the injection holes or the directions of the jets are separated further away from each other as flowing to the downstream side. Therefore, it is conventionally difficult to achieve both the requirements, that is, the atomization and the compact sprays.

Moreover, it is also considered to quickly attenuate the penetration force of the sprays at a predetermined position for the purposes of reducing the collision of the sprays against the vicinity of the intake valve and promoting the mixture with air. However, there conventionally exists no means to realize the attenuation of the penetration force without greatly changing the spray form.

In a port injection system, the adhesion of the fuel to the intake port does not provide any beneficial influence and effects. Therefore, the suppression of the adhesion of the fuel is the biggest challenge.

Thus, even when the atomization is improved to lower a rate of the adhesion of the sprays to the intake valve or the intake port in the vicinity of the intake valve, advantages obtained thereby as the port injection system can be hardly found because side surfaces of the sprays adhere to another intake port as a result of the spread of the entire spray.

Specifically, even when the atomization is promoted by setting a direction of each of the liquid film flows at a wide angle or a big swirl is generated on the outer circumference of the atomized spray to greatly change the spray form to keep the penetration force small, a spray at a wide angle is eventually generated to induce the interference with the intake valve or the intake port to result in the adhesion of the fuel.

On the other hand, as the technique of suppressing the spread of the entire spray, there is known a technique for setting the arrangement of the injection holes and the injection-hole data or the arrangement of the jets and the directions of the jets so that the central axis lines of the injection holes or the directions of the jets cross each other immediately below the injection holes. However, there is no known technique that takes atomization requirements such as the relationship with a breakup length of a liquid film flow (length from the outlet of a corresponding injection hole to a position at which the liquid film flow can be substantially regarded as a spray flow after rupture and breakup of the liquid film flow) into consideration.

When the spread of the entire spray is to be suppressed, an angle of the central axis line of each of the injection holes with respect to a vertical line (Z axis illustrated in FIG. 1) becomes relatively small, which is disadvantageous for the formation of thin liquid film flow. Therefore, the atomization process becomes slower. As a result, the jets are more likely to interfere with each other. Thus, an atomization level cannot be realized as an expected value.

Further, in this case, when the coalescence of the plurality of sprays proceeds to have a spray form close to that described in Transactions of the Japan Society of Mechanical Engineers (Part II), Vol. 25, No. 156, pp. 820 to 826, "Studies on the Penetration of Fuel Spray of Diesel Engine", by Wakuri et al. As a result, the penetration force of the coalescent spray becomes larger than that of the single sprays.

In this context, the inventor of the present invention pays attention to a difference between a behavior of the single spray injected from the single injection hole and a behavior of the coalescent spray formed by the coalescence of the plurality of single sprays injected from the plurality of injection holes. As a result, the inventor of the present invention has found a technique of controlling the shape, the penetration force, the injection-amount distribution, and the direction of spray of the integrated spray by skillfully combining the above-mentioned spray behaviors and an axis switching phenomenon which is a finding in fluid engineering.

The findings of the axis switching phenomenon are described in the following academic documents.

[Academic Document 1] The Japan Society of Mechanical Engineers (Series B), Vol. 55, No. 514, pp. 1542 to 1545, "A Study of the Vortical Structures of Noncircular Jets", by Toyoda et al.

[Academic Document 2] ILASS-Europe 2010, "An experimental investigation of discharge coefficient and cavitation length in the elliptical nozzles" (Sung Ryoul Kim)

[Academic Document 3] Seisan Kenkyu Vol. 50 No. 1 pp 69-72, "Numerical Simulation of Complex Turbulent Jets: Origin of Axis-Switching" (Ayodeji O.DEMUREN)

[Academic Document 4] "Jet flow engineering", MORIKITA PUBLISHING Co., Ltd. pp 41-42

In the field of search of the jet, the axis switching phenomenon is not limited to an example of this embodiment in which the sectional shape of the spray is oval, but the axis switching phenomenon occurs as long as at least a long axis is substantially in line-symmetric with respect to a short axis of the oval. Moreover, the axis switching phenomenon occurs not only in a liquid but also in a gas.

In the case of a spray having an oval cross section with a large ratio of the long axis to the short axis, the direction of the long axis and the direction of the short axis may change to deform the cross section as long as the direction of the long axis is not segmentalized.

Therefore, in this embodiment, an angle at which the direction of the long axis and the direction of the short axis of the spray are changed is set to about 90 degrees.

Figure 6A:
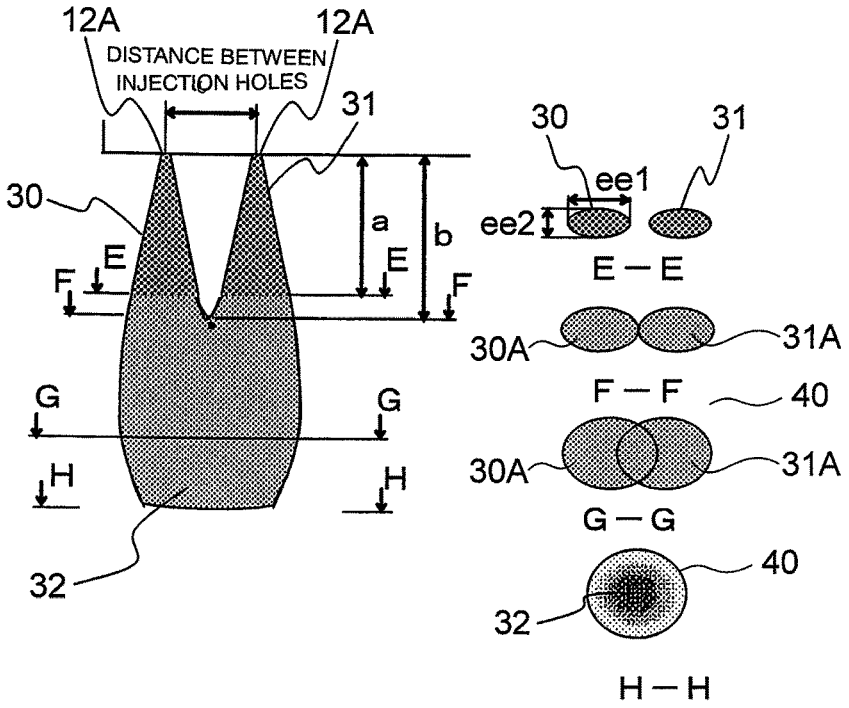
FIGS. 6A and 6B are explanatory diagrams illustrating behaviors of single sprays.
Figure 6B:
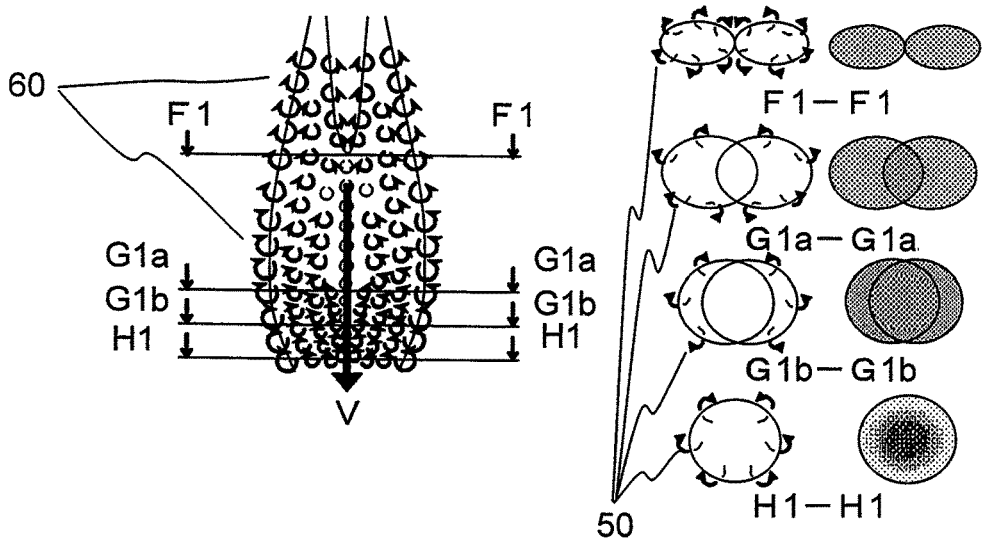

The fuel injection valve 1 illustrated in FIG. 1 is realized based on the finding of the technique of controlling of the shape, the penetration force, the injection-amount distribution, and the spray directions of the integrated spray by the inventor of the present invention. FIGS. 6A and 6B are explanatory diagrams illustrating behaviors of single sprays 30A and 31A of the fuel injection valve 1.

Figure 7A:
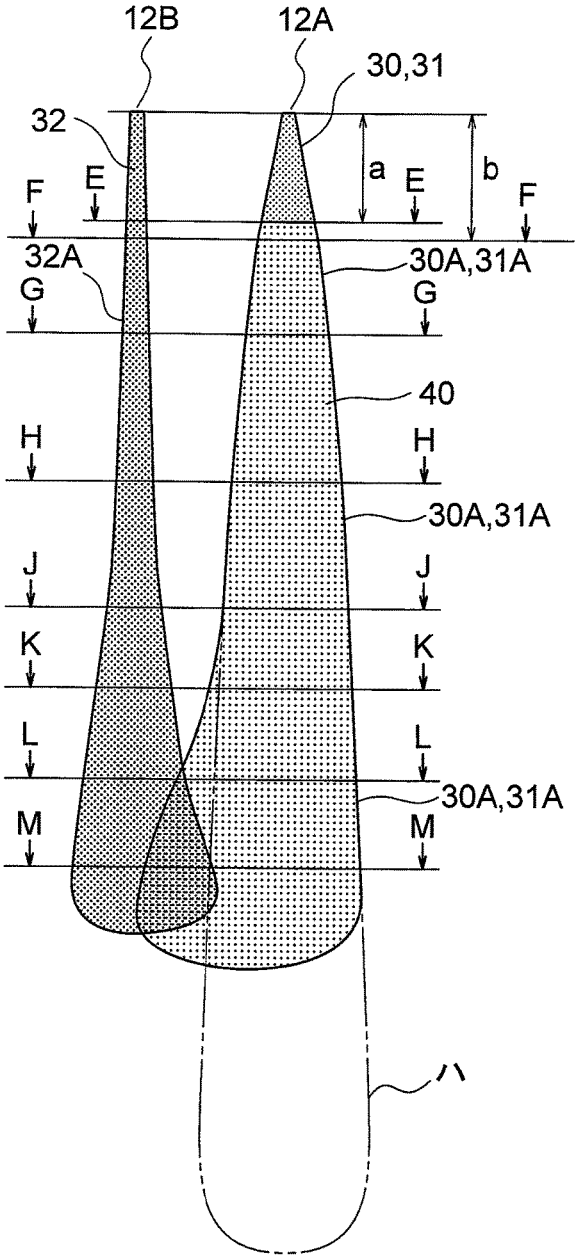
FIGS. 7A and 7B are explanatory diagrams illustrating behaviors of the single sprays and a switching spray by the fuel injection valve according to the first embodiment of the present invention.
Figure 7B:
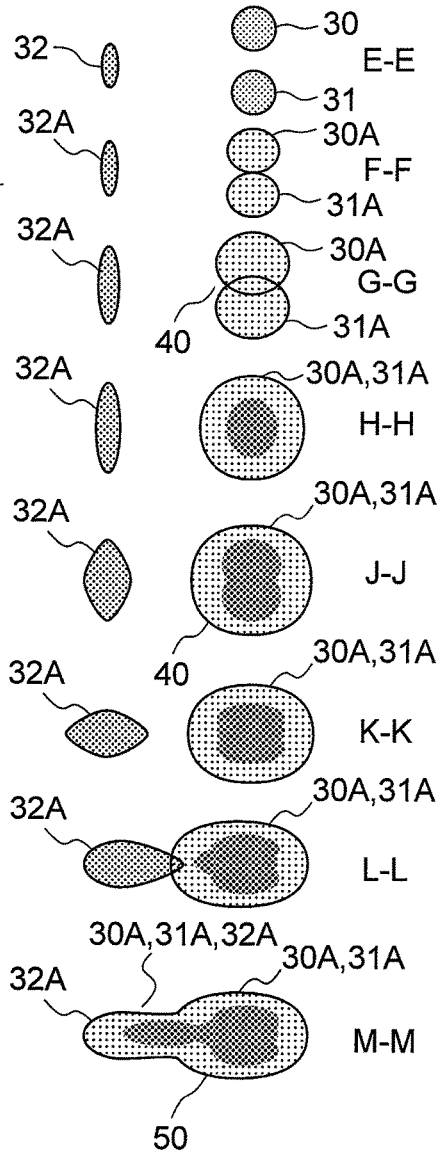

FIGS. 7A and 7B are explanatory diagrams illustrating behaviors of the single sprays 30A and 31A and a switching spray 32A of the fuel injection valve 1.

In the fuel injection valve 1, jets 30 and 31 injected from the plurality of coalescent-spray injection holes 12A become the single sprays 30A and 31A, which coalesce to form a coalescent spray 40 at the downstream. A jet 32 having an oval cross section injected from the switching-spray injection hole 12B becomes a switching spray 32A with directions of a long axis and a short axis changing due to the axis switching phenomenon at the downstream. The coalescent spray 40 and the switching spray 32A form an integrated spray 50 under the Coanda effect.

In the coalescent spray 40, a center or center of gravity of the injection-amount distribution of each of the coalesced single sprays 30A and 31A converges to a center or center of gravity of the coalescent spray 40.

In FIG. 6A, sectional shapes of the jets 30 and 31 injected from the adjacent coalescent-spray injection holes 12A when breakup occurs between the jets 30 and 31 are shapes taken along the line E-E.

A distance between the coalescent-spray injection holes 12A and the cross section E-E is referred to as a breakup length a.

Subsequently, the jets 30 and 31 respectively become the single sprays 30A and 31A in a separated manner. Then, at a position away from the coalescent-spray injection holes 12A by distance b, outer peripheries of the two single sprays 30A and 31A start to come into contact with each other (cross section F-F). The distance b from the coalescent-spray injection holes 12A is referred to as an interference distance.

The injection-amount distribution of the fuel on a plane of each of the single sprays 30A and 31A, which is perpendicular to the center axis line of each of the coalescent-spray injection holes 12A may be arbitrarily set to have any form depending on the injection-amount distribution of the single sprays 30A and 31A, resulting from features of the jets 30 and 31, for example, an approximately uniform distribution, a caldera-like shape, or a conical shape having a peak on the center.

Simultaneously, from a state illustrated as the cross sections F-F, the single sprays 30A and 31A come closer to each other under the Coanda effect acting between the two single sprays 30A and 31A due to the pressure distribution to coalesce as illustrated as the cross section G-G. Then, ambient-air entrainment around the single sprays 30A and 31A is caused. As a result, an air flow along the direction of downstream flow from a predetermined portion in the single sprays 30A and 31A is induced.

Figure 12:
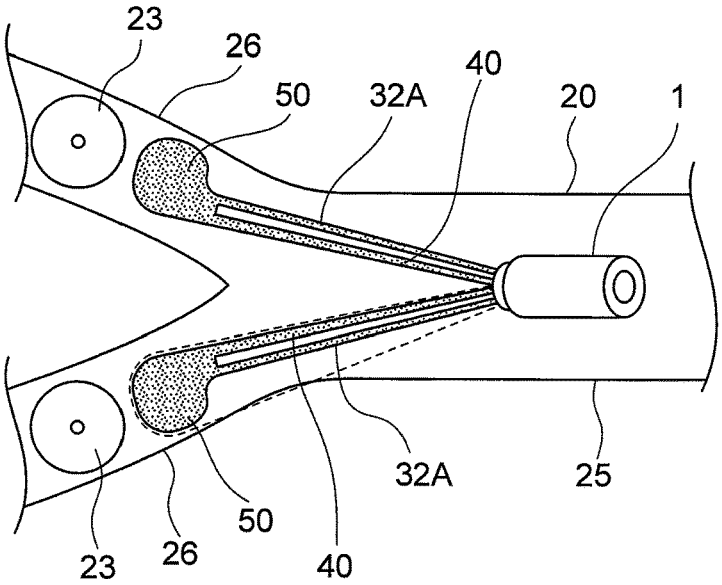
FIG. 12 is a plan view of FIG. 11.

A level of the ambient-air entrainment is not as high as a level at which the whole shape of the coalescent spray 40 formed by coalescence of the single sprays 30A and 31A is greatly changed, but is at a level illustrated in FIG. 12(*a*) or at a level illustrated in FIG. 12(*b*) only for spray microparticles, which are described in Transactions of the Japan Society of Mechanical Engineers (Series B), Vol. 62, No. 599, pp. 2867 to 2873, "Effect of Ambient Gas Viscosity on the Structure of Diesel Fuel Spray", by Dan et al.

If conditions are appropriate, the two single sprays 30A and 31A in the state of the coalescent spray 40 whose cross section H-H is illustrated in FIG. 6A further coalesce. As a result, the substantially single solid coalescent spray 40 is formed.

In FIG. 6B, conditions of the ambient-air entrainment are indicated by a large number of spiral arrows 60 in an exaggerated fashion for easy understanding.

Therefore, the magnitude and the number of the spiral arrows 60 do not represent an actual state of the ambient-air entrainment.

An air flow V along the direction of downstream flow from the predetermined portion in the sprays is induced.

As a result, the injection-amount distribution gradually approaches a peak approximately at the center as illustrated on the right part of FIG. 6B as specifically illustrated as the cross sections F1-F1, G1*a*-G1*a*, G1*b*-G1*b*, and H1-H1.

On the other hand, when breakup occurs in the jet 32 injected from the switching-spray injection hole 12B, the switching spray 32A has a sectional shape as illustrated in FIG. 7B taken along the line E-E illustrated in FIG. 7A.

The jet 32 becomes the individual switching spray 32A. As is understood from FIG. 7B, the switching spray 32A having the oval cross section is provided so as to be opposed to a pair of the single sprays 30A and 31A which are arranged along a long axis of the cross section of the switching spray 32A.

Subsequently, the switching spray 32A has a slightly increasing cross section (in both of the long-axis direction and the short-axis direction) while being opposed to the coalescent spray 40 formed by the coalescence of the single sprays 30A and 31A. Meanwhile, the switching spray 32A maintains a direction of flow approximately immediately below the switching-spray injection holes 12B and then directly flows to the downstream side.

Then, at a timing at which the single sprays 30A and 31A further coalesce and the Coanda effect becomes weaker, the deformation of the switching spray 32A with changes in both the long-axis direction and the short-axis direction starts (cross section J-J).

In the case where the deformation of the switching spray 32A with changes in both the long-axis direction and the short-axis direction occurs when the Coanda effect between the single sprays 30A and 31A is still strong before the single sprays 30A and 31A considerably coalesce, a distance between the switching spray 32A and the single sprays 30A and 31A becomes shorter. As a result, the switching spray 32A and the single sprays 30A and 31A are quickly integrated with each other.

To the downstream side, that is, from the state illustrated as the cross section J-J to the state illustrated as the cross section K-K, the deformation of the switching spray 32A with change in both the long-axis direction and the short-axis direction proceeds. The switching spray 32A and the coalescent spray 40 formed by the single sprays 30A and 31A come closer to each other.

The above-mentioned phenomenon occurs for the following reason. A space between the switching spray 32A and the coalescent spray 40 becomes smaller by the change of the long-axis direction and the short-axis direction of the switching spray 32A (the initial long-axis direction now becomes the short-axis direction). With the reduced space, the Coanda effect between the switching spray 32A and the coalescent spray 40 occurs.

Then, as illustrated as the cross section L-L, an end portion of the switching spray 32A and an end portion of the coalescent spray 40, which are opposed to each other, deform (move) to start interfering with each other.

As a result, as illustrated as the cross section M-M, at a predetermined timing after the fuel injection and at a predetermined distance away from the coalescent-spray injection hole 12A and the switching-spray injection hole 12B, mutual effects of the switching spray 32A and the coalescent spray 40 can be set to a predetermined level in accordance with the specifications of the integrated spray 50. As a result, at a position illustrated as the cross section M-M, the degree of freedom in setting of the shape, the penetration force, and the injection-amount distribution of the integrated spray 50 is improved.

As a result of the deformation of the switching spray 32A with change in both the long-axis direction and the short-axis direction, momentum exchange between the switching spray 32A and the ambient air greatly proceeds to reduce the penetration force. Therefore, by the interference with the coalescent spray 40, the penetration force of the coalescent spray 40 is also suppressed.

Thus, in the case of the coalescent spray 40 alone, a distal end of the coalescent spray 40 extends as indicated by an imaginary line W illustrated in FIG. 7A. On the other hand, the distal end of the coalescent spray 40 is shortened due to the interference with the switching spray 32A in this embodiment. Moreover, as a result of the suppression of the penetration force of the coalescent spray 40, the Coanda effect in the coalescent spray 40 is approximately attenuated to be no longer exerted.

Further, the penetration force of the switching spray 32A is reduced to significantly develop the mixture with the ambient air. As a result, the atomization of the switching spray 32A is improved. Consequently, a difference between a level of the atomization of the switching spray 32A and that of the coalescent spray 40 becomes smaller.

Specifically, at a predetermined position which is located downstream of the coalescent-spray injection hole 12A and the switching-spray injection hole 12B at a certain distance away, the integrated spray 50 with an asymmetric shape, which has a relatively nearly uniform structure, can be formed.

The exertion of the Coanda effect between the switching spray 32A and the coalescent spray 40 before the long-axis direction and the short-axis direction of the switching spray 32A change to deform the switching spray 32A can be reliably suppressed by adopting the following method.

Specifically, at a position the same distance away from the coalescent-spray injection hole 12A and the switching-spray injection hole 12B in the main flow direction, any one of the following methods should be adopted. Specifically, one of the methods is to set a mean particle diameter of the switching spray 32A larger than that of the coalescent spray 40. Another method is to set a breakup length of the switching spray 32A longer than that of each of the single sprays 30A and 31A forming the coalescent spray 40. Further another method is to set the penetration force of the switching spray 32A larger than that of the coalescent spray 40.

For the realization of the above-mentioned methods, different levels of the contracted flows by using, for example, a difference between the shapes of the coalescent-spray injection hole 12A and the switching-spray injection hole 12B may be used.

Further, by adjusting the injection amounts, the cross-sections, the injection directions, and the atomization levels of the switching spray 32A and the coalescent spray 40, a spray direction can be changed from the previous spray direction after the switching spray 32A and the coalescent spray 40 coalesce under the Coanda effect to become the integrated spray 50.

Moreover, even after the switching spray 32A and the coalescent spray 40 are integrated as the integrated spray 50 to significantly lower the momentum of the spray, the direction of flow of the integrated spray 50 can be changed with a curvature.

In sum, the above-mentioned direction of flow and change in shape of the integrated spray 50 are determined by a distribution of the momentum in the integrated spray 50.

In the first embodiment, in order to provide the degree of freedom to the characteristics of the coalescent spray 40, such as the spray shape, the penetration force, the injection-amount distribution, and the spray direction while the characteristics of the compact coalescent spray 40 as illustrated in FIGS. 6A and 6B are maintained, the switching spray 32A with the oval sectional shape having different characteristics from those of the single sprays 30A and 31A forming the coalescent spray 40 is used.

Specifically, at the downstream in the coalescent spray 40, at which the Coanda effect becomes weaker, the switching spray 32A with the oval sectional shape, which is located at a small distance away from the coalescent spray 40, is deformed with the change of the long-axis direction and the short-axis direction due to the axis-switching phenomenon. As a result, the switching spray 32A and the coalescent spray 40 affect each other to result in obtaining the integrated spray 50 having a high degree of freedom, which obtains the desired characteristics (spray shape, penetration force, injection-amount distribution, spray direction, and the like).

In order to obtain the desired integrated spray 50, a timing at which the switching spray 32A and the coalescent spray 40 start affecting each other, that is, a timing at which the long-axis direction and the short-axis direction of the switching spray 32A start changing and a timing at which the Coanda effect in the coalescent spray 40 starts weakening (cross section J-J illustrated in FIGS. 7A and 7B) should be brought into synchronization.

Moreover, the shapes of the coalescent-spray injection hole 12A and the switching-spray injection hole 12B, and the distance, the difference in penetration force, and a difference in spread between the switching spray 32A and the coalescent spray 40 should be adjusted.

In the case of the port injection, a density of the number of the spray particles at the downstream at the breakup length a away from the injection hole is remarkably small as compared with those of a gasoline in-cylinder injection spray or a diesel spray (about 1/10 of that of the gasoline in-cylinder injection spray or lower and about 1/100 of that of the diesel spray or lower). The spray particles basically move in the same direction at the same speed. Therefore, it can be considered that the collision and the integration between the particles scarcely occur.

Moreover, at a level of a fuel pressure of 0.3 MPa in the case of the port injection, it may be considered that breakup from the single particle does not occur.

As described above, according to the fuel injection valve 1 of the first embodiment of the present invention, the coalescent spray 40 before the injection-amount distribution of the coalesced single sprays 30A and 31A reaches the center of the coalescent spray 40 and the switching spray 32A injected from the switching-spray injection hole 12B coalesce under the Coanda effect to form the integrated spray 50.

Therefore, at least a part of the spray shape, the penetration force, the injection-amount distribution, and the spray direction, which cannot be obtained by the coalescent spray formed by general multiple injection-hole spray, can be realized while compact multiple injection-hole atomized spray is realized with the coalescent spray 40. As a result, the degree of freedom in the design of the spray specifications can be significantly improved.

In this manner, the collision of the integrated spray 50 against the intake valve and the wall surface of the intake port on the downstream side can be remarkably suppressed as compared with the conventional cases.

In the case where the collision of the integrated spray 50 against the intake valve and the wall surface of the intake port cannot be avoided only by changing the shape of the integrated spray 50, the direction of the integrated spray 50 can be changed in the middle by using the momentum distribution in the integrated spray 50.

Further, the shape, the penetration force, the injection-amount distribution, and the direction of the integrated spray 50 can be set so as to accelerate the formation of a homogenous air-fuel mixture in accordance with an air flux in the intake port in a state in which the intake valve is closed.

Moreover, for example, during the injection in an intake stroke, the integrated spray 50 can more easily follow an intake-air flux flowing through the intake valve into a cylinder, and therefore can flow into the cylinder without interfering with the intake valve and the wall surface of the intake port in the vicinity thereof. As a result, the improvement of a charging efficiency by the intake-air cooling effect in the cylinder can be realized.

Even in this case, the interference with the intake valve and the wall surface of the intake port in the vicinity thereof cannot be avoided only by changing the shape of the integrated spray 50 and the like, the above-mentioned setting is made so that the direction of the integrated spray 50 changes in the middle. As a result, the integrated spray 50 can follow the intake-air flux.

Thus, by controlling the penetration force without widening the angle of each of the single sprays 30A and 31A, the degree of freedom in the entire injection system is increased. Moreover, engine performance is improved.

Second Embodiment

Next, a fuel injection valve 1 according to a second embodiment of the present invention is described.

Figure 8A:
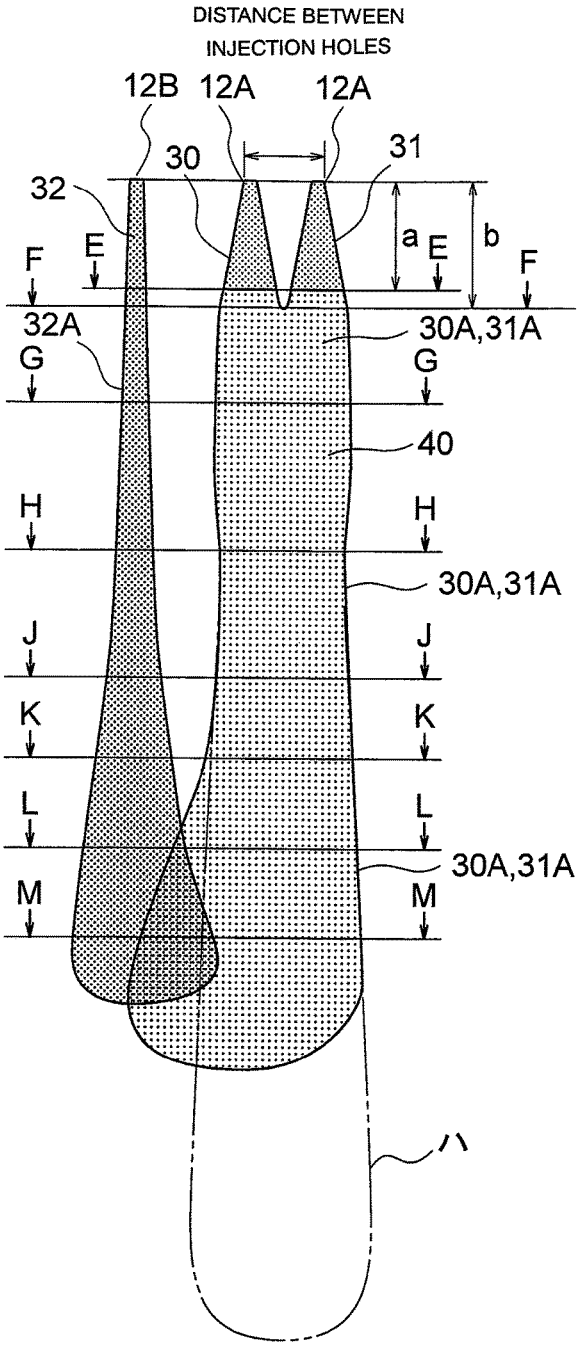
FIGS. 8A and 8B are explanatory diagrams illustrating behaviors of single sprays and a switching spray by a fuel injection valve according to a second embodiment of the present invention.
Figure 8B:
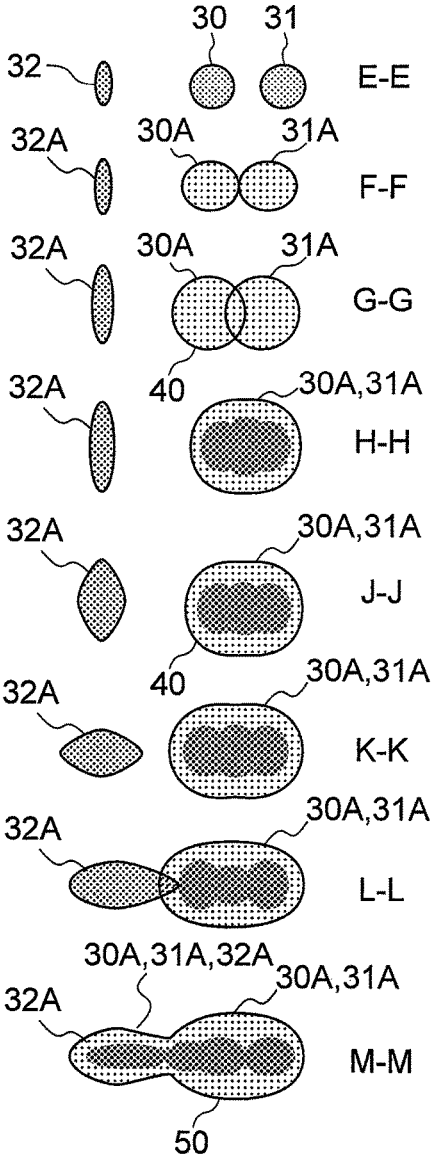

FIGS. 8A and 8B are diagrams illustrating behaviors of the coalescent spray 40 and the switching spray 32A which mutually affect each other in the fuel injection valve 1 according to the second embodiment.

In the second embodiment, the single sprays 30A and 31A opposed to the switching spray 32A having the oval sectional shape are arranged along and opposite to the short axis of the switching spray 32A immediately below the coalescent-spray injection hole 12A and the switching-spray injection hole 12B, as illustrated in FIG. 8B.

Specifically, the fuel injection valve 1 according to the second embodiment differs from that according to the first embodiment in that the single sprays 30A and 31A are arranged along and opposite to the long axis of the switching spray 32A having the oval sectional shape immediately below the coalescent-spray injection holes 12A and the switching-spray injection hole 12B in the first embodiment.

The remaining configuration is the same as that of the fuel injection valve 1 according to the first embodiment. Moreover, the functions and effects of the fuel injection valve 1 are the same as those of the fuel injection valve 1 according to the first embodiment.

Third Embodiment

Figure 9:
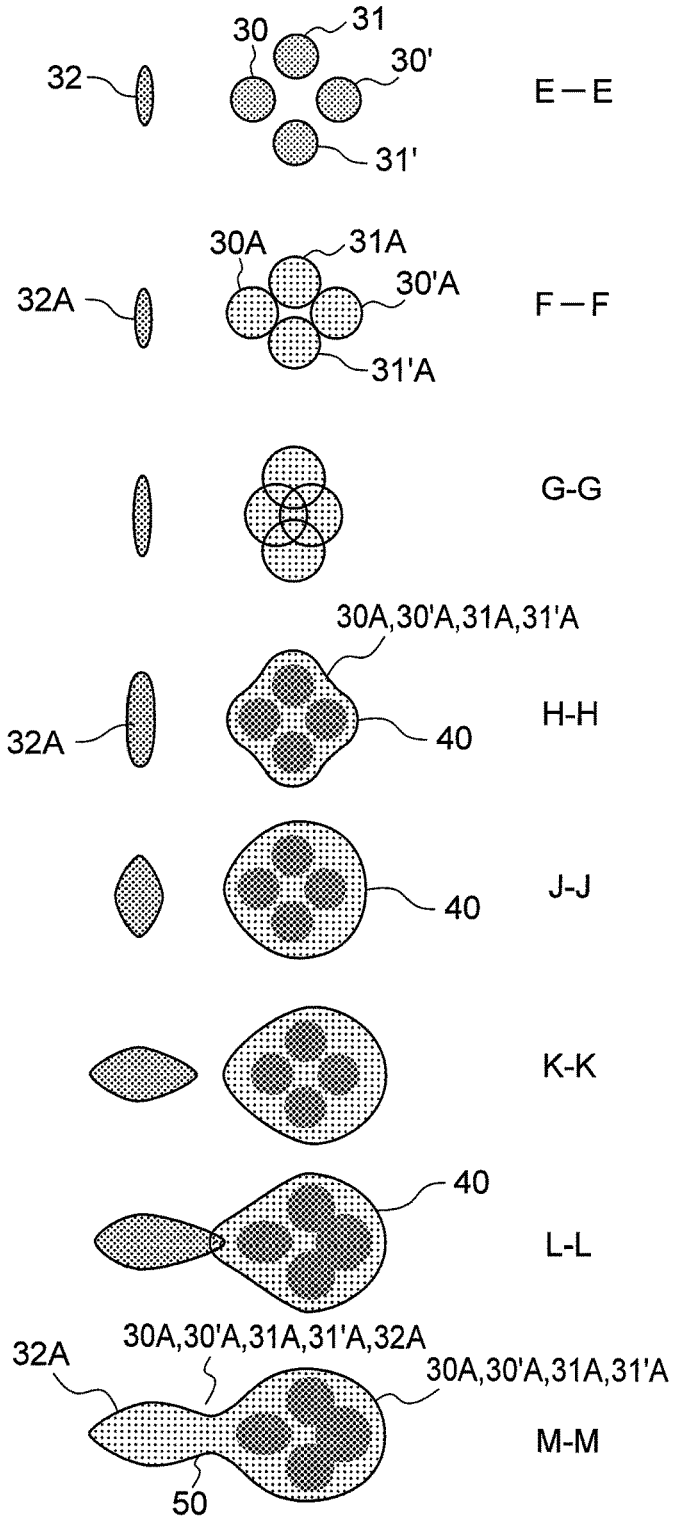
FIG. 9 is an explanatory diagram illustrating behaviors of single sprays and a switching spray by a fuel injection valve according to a third embodiment of the present invention.

FIG. 9 illustrates the coalescent spray 40 which are formed by four single sprays 30A, 30A', 31A, and 31A'.

Even in this case, the same spray behaviors as those in the first and second embodiments can be basically realized. When the single sprays 30A, 30A', 31A, and 31A' are arranged as illustrated in FIG. 9, a length of the integrated spray 50 in a vertical direction of FIG. 9 can be increased as compared with that of the integrated spray 50 of the first embodiment.

As described above, by variously combining the characteristics (sectional shape, injection amount, particle-diameter level, penetration force, and the like) and arrangements of the single sprays 30A, 30A', 31A, and 31A' which form the coalescent spray 40, the characteristics (sectional shape, injection amount, particle-diameter level, penetration force, and the like) of the coalescent spray 40 can be variously set.

In order to enable the above-mentioned setting, the characteristics of the coalescent spray 40 are required to be selective in the following manner. Specifically, the injection-amount distribution of the coalescent spray 40 is prevented from increasing the degree of concentration thereof to be a conical distribution having a peak at the center so that the single sprays 30A, 30A', 31A, and 31A' which form the coalescent spray 40 can be identified from each other.

Even for the switching spray 32A, the long-axis direction and the short-axis direction on the corresponding plane are changed due to the axis-switching phenomenon under the predetermined conditions. In the range where the cross section of the switching spray 32A can be deformed, the setting of the sectional shape has the degree of freedom.

The shape and arrangement of the integrated spray 50, that is, the momentum distribution and direction can be set when the single coalescent spray 40 is formed by combining the above-mentioned elements.

Therefore, the spray direction of the integrated spray 50 can be started to be changed in the vicinity of the position which is illustrated as the cross section M-M. When the distribution of the momentum and the change of the direction continue even at the downstream of the cross section M-M at which the integrated spray 50 is formed, the spray direction can be continuously changed, such as providing a curvature to the spray direction.

It is apparent that the number of the single sprays 30A, 30A', 31A, and 31A' which form the coalescent spray 40 is not limited. Further, the number and arrangement of the switching spray 32A having the oval sectional shape is not limited.

Fourth Embodiment

Figure 10:
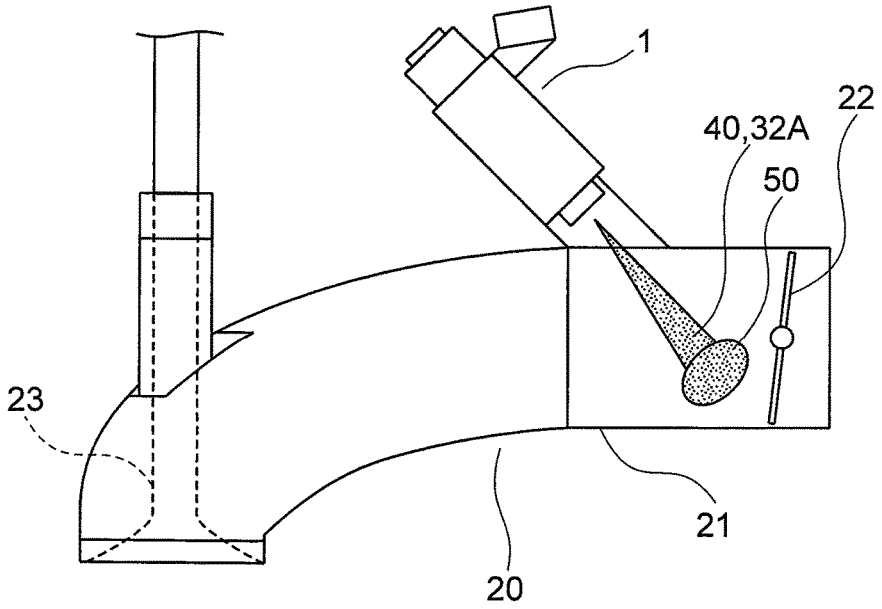
FIG. 10 is a configuration diagram illustrating an example of a mode of use of a fuel injection valve according to a fourth embodiment of the present invention.

FIG. 10 is a configuration diagram illustrating an example where the fuel injection valve 1 having the above-mention configuration is mounted to a throttle body 21 of the intake port 20.

In this example, the fuel injection valve 1 is provided downstream of a throttle valve 22. A distal end portion of the fuel injection valve 1 is oriented so as to inject the fuel to the upstream side of the intake-air flow.

The coalescent spray 40 and the switching spray 32A, which are generated by the fuel injection from the fuel injection valve 1, ultimately become the integrated spray 50. The penetration force of the integrated spray 50 is suddenly suppressed immediately before reaching the throttle valve 22 and the wall surface of the throttle body 21.

Therefore, after the injection of the fuel to the upstream side, a spatial margin for allowing the generation of the air-fuel mixture of the fuel and the air, that is, a spatial margin between an intake valve 23 and the integrated spray 50 can be provided.

As a result, if the fuel is injected in a direction to the downstream side of the intake-air flow when a length of the intake port 20 is enormously short, the injection-amount distribution between the cylinders becomes unbalanced or a rate of adhesion of the spray to the inner wall surface of the intake port 20 increases to result in the degradation of an air-fuel mixture formation state or the prevention of improvement of engine performance. The above-mentioned disadvantages are eliminated by providing the spatial margin.

Figure 11:
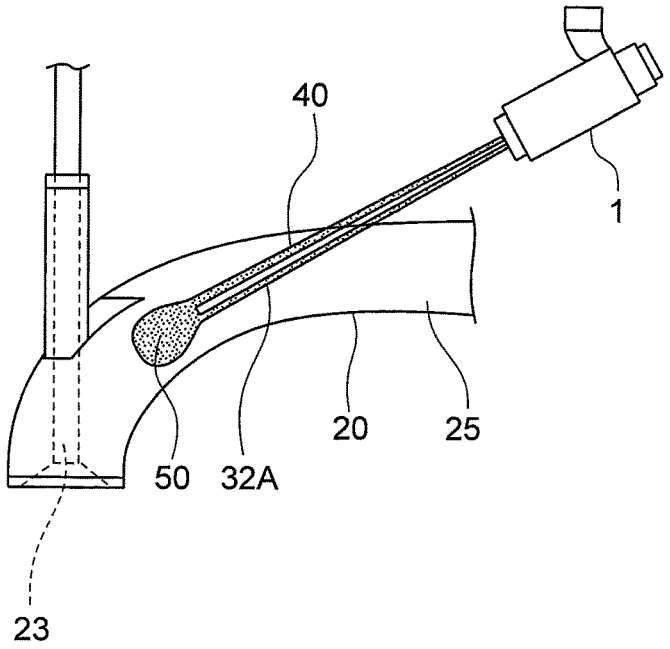
FIG. 11 is a configuration diagram illustrating another example of the mode of use of the fuel injection valve according to the fourth embodiment of the present invention.

FIG. 11 is a configuration diagram illustrating an example where the above-mentioned fuel injection valve 1 is mounted to an intake-pipe collection part 25 of the intake port 20, and FIG. 12 is a plan view of FIG. 11.

In this example, the fuel injection valve 1 is mounted to the intake-pipe collection part 25. A downstream side of the intake-pipe collection part 25 is connected to a bifurcating portion 26. A cylinder (not shown) is connected to the bifurcating portion 26. The intake valve 23 is mounted to the bifurcating portion 26. The distal end portion of the fuel injection valve 1 is oriented so as to inject the fuel to the respective intake valves 23.

The coalescent spray 40 and the switching spray 32A, which are generated by the fuel injection from the fuel injection valve 1, ultimately become the integrated spray 50. As described above, the penetration force of the integrated spray 50 is suddenly suppressed immediately before reaching the intake valve 23 and the inner wall surface of the bifurcating portion 26.

Moreover, the sprays coalesce under the Coanda effect between the coalescent spray 40 and the switching spray 32A. Therefore, the spray can be prevented from directly adhering to the inner wall surface of the intake port 20, as indicated by a dotted line in FIG. 12.

Moreover, as can be understood from FIGS. 11 and 12, the integrated spray 50 has a shape so that the integrated spray 50 does not directly interfere with the inner wall surface of the bifurcating portion 26 and the intake valves 23.

As described above, in this example, only one fuel injection valve 1 is provided to the intake-pipe collection part 25. In this manner, the spray at a wide angle can be formed while suppressing the adhesion of the spray to the inner wall surface of the intake port 20, which covers the vicinity of the intake valves 23 of the respective cylinders, and suppressing the penetration force of the integrated spray 50 in the vicinity of the intake valves 23.

The above-mentioned system which uses only one fuel injection valve 1 for a multi-cylinder engine (so-called "single point injection") improves cost performance of the engine, and therefore is extremely useful.

Specifically, currently used carburetors are more and more replaced by the fuel injection system in utility engines and small engines. However, it is difficult to remarkably increase cost. Therefore, the use of the single point injection illustrated in FIGS. 11 and 12 is extremely useful.

Figure 13:
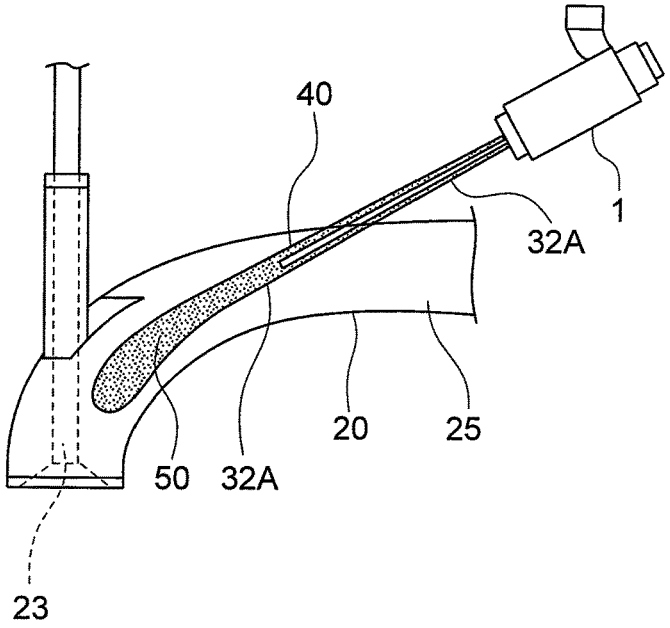
FIG. 13 is a configuration diagram illustrating yet another example of the mode of use of the fuel injection valve according to the fourth embodiment of the present invention.
Figure 14:
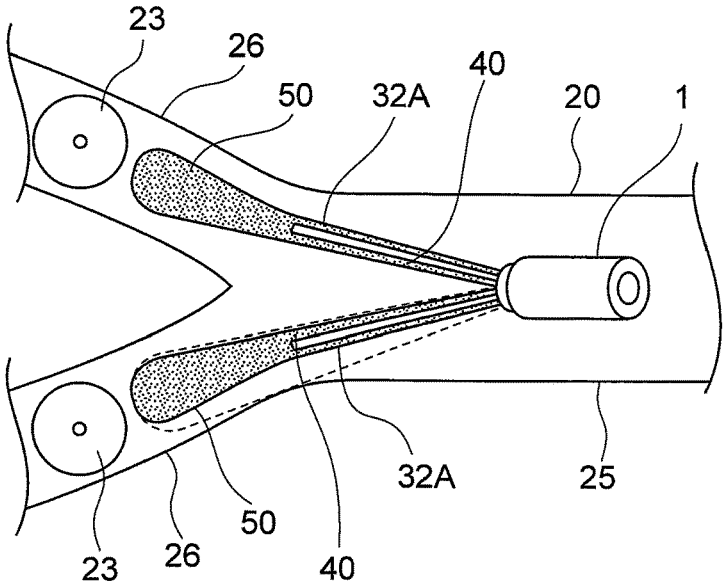
FIG. 14 is a plan view of FIG. 13.

FIG. 13 is a configuration diagram illustrating another example where the above-mentioned fuel injection valve 1 is mounted to the intake-pipe collection part 25 of the intake port 20, and FIG. 14 is a plan view of FIG. 13.

Even in this example, the fuel injection valve 1 is mounted to the intake port 20 so that the distal end portion of the fuel injection valve 1 is oriented to the intake valves 23.

The coalescent spray 40 and the switching spray 32A, which are generated by the fuel injection from the fuel injection valve 1, ultimately become the integrated spray 50. As described above, the direction of orientation of the integrated spray 50 has the curvature so as to avoid the direct collision of the integrated spray 50 against the wall surface of the intake port 20.

Moreover, the sprays coalesce under the Coanda effect between the coalescent spray 40 and the switching spray 32A. Therefore, the spray can be prevented from directly adhering to the inner wall surface of the intake port 20, as indicated by a dotted line in FIG. 14.

As described above, in the intake port 20 in the vicinity of the intake valve 23, which has a so-called three-dimensionally irregular sectional shape for a normal fluid passage, the direct adhesion of the fuel spray to the inner wall surface of the intake port 20 can be suppressed.

FIGS. 11 to 14 illustrate the examples where one intake valve 23 is provided to each cylinder and the single fuel injection valve 1 is used for the two cylinders. However, the present invention is also applicable to an example where the two intake valves 23 is provided to each cylinder and the single fuel injection valve 1 is used for one cylinder.

In the case of a gasoline engine having the two intake valves 23, when two integrated sprays respectively corresponding to the intake valves 23 are formed, the degree of freedom in design of each of the two spray is considerably improved.

After the improvement of the degree of freedom in design, the specifications of the integrated spray 50, such as the suppression of adhesion of the spray to the inner wall surface of the intake port 20, the formation of the homogenous air-fuel mixture by matching between the spray and the air flux, and the in-cylinder direct injection by the spray following the intake-air flux, should be determined in accordance with a purpose.

In the embodiments described above, the single-spray pattern illustrated in FIG. 10 and the double-spray patterns illustrated in FIGS. 11 to 14 are described. However, various specifications such as multiple-spray patterns including a triple-spray pattern or the combination of the integrated sprays 50 having different shapes can be realized.

The electromagnetic fuel injection valve has been described as the fuel injection valve 1 according to each of the embodiments. However, it is apparent that other systems may be used as a driving source. Specifically, a piezoelectric fuel injection valve or a mechanical fuel injection valve may be used. Moreover, it is also apparent that the present invention is applicable to a continuous injection valve instead of a timed injection valve.

The present invention covers a wide range of proposes of use and required functions other than the fuel injection valve 1, such as various sprays to be used for general industry, farming industry, equipment, home use, and personal use, for the purposes of painting and coating, pesticide spraying, cleaning, humidification, use for sprinklers, antiseptic spraying, and cooling.

Therefore, regardless of the driving source, the nozzle shape, and the sprayed fluid, an unconventional spray shape can be realized by incorporating the fluid injection valve of the present invention into the spray generators described above.

What is claimed is:

1. A fluid injection valve, comprising:

a fixed core;

a coil which surrounds the fixed core and is supplied with a current according to an operation signal;

a movable armature which is provided inside the coil and moved when the current is supplied to the coil;

a valve seat provided in a midway of a fluid passage through which a fluid flows;

a valve element having a ball fixed to a rod welded to the movable armature and configured to drive the ball to come into contact with and be separated away from the valve seat to control closure and opening, respectively, of the fluid passage; and an injection-hole plate including a plurality of injection holes disposed proximate one another along a curve, provided at a downstream of the valve seat, the plurality of injection holes including a switching-spray injection hole having an oval cross section and coalescent-spray injection holes disposed along the curve on both sides of the switching-spray injection hole and opposite to a long axis of the switching-spray injection hole, each of the coalescent-spray injection holes having a circular cross section, wherein the fluid injection valve is configured to inject respective jets from the plurality of injection holes to form sprays at a downstream of the plurality of injection holes, the sprays ultimately coalescing to form an integrated spray, wherein, in response to the current being supplied to the coil based on the operation signal, the movable armature is configured to move together with the rod which drives the ball to open the fluid passage in the fluid injection valve which injects, from the switching-spray injection hole, a switching spray having different lengths of a long axis and a short axis on a plane perpendicular to a flow direction, which corresponds to the switching spray after an injection of the respective jet, and causes a direction of the long axis and a direction of the short axis of a cross section of the switching spray to change to deform the switching spray at a downstream position of the switching spray in the flow direction, and injects, from the coalescent-spray injection holes, respective jets configured to form a coalescent spray formed by coalescence of single sprays under Coanda effect exerted between the single sprays on a downstream side of a breakup position at which the respective jets break up into the single sprays after rupture and breakup, wherein the fluid injection valve is further configured to inject the switching spray with a greater penetration force than a penetration force of the single sprays injected through the coalescent-spray injection holes so that the direction of the long axis and the direction of the short axis of the cross section of the switching spray change at a downstream position from where the Coanda effect is exerted between the single sprays, wherein, after the direction of the long axis and the direction of the short axis of the cross section of the switching spray change, the coalescent spray and the switching spray coalesce under the Coanda effect to form the integrated spray before a gravity center of an injection-amount distribution of each of the coalesced single sprays converges to a gravity center of the coalescent spray, thereby reducing a penetration force of the integrated spray.

2. A fluid injection valve according to claim 1, wherein at least one characteristics of the integrated spray, including a shape, the penetration force, the injection-amount distribution, and a spray direction, is determined at the downstream position of the switching spray where the direction of the long axis and the direction of the short axis of the cross section of the switching spray change.

3. A fluid injection valve according to claim 1, wherein the switching-spray injection hole and the coalescent-spray injection holes are arranged to be separated away from each other so that the switching spray and the coalescent spray coalescence under the Coanda effect to form the integrated spray at the downstream position of the switching spray where the direction of the long axis and the direction of the short axis of the cross section of the switching spray change.

4. A fluid injection valve according to claim 1, wherein the long axis of the cross section of the switching spray is approximately line-symmetric at least to the short axis.

5. A fluid injection valve according to claim 1, wherein the long axis of the switching spray is opposed to the single sprays.

6. A fluid injection valve according to claim 2, wherein:

the fluid injection valve is mounted to an intake port on a downstream side of an intake-air flow of a throttle valve so that a distal end portion of the fluid injection valve is oriented toward the throttle valve; and the penetration force of the integrated spray is suppressed before reaching the throttle valve.

7. A fluid injection valve according to claim 2, wherein:

the fluid injection valve is mounted to an intake port so that a distal end portion of the fluid injection valve is oriented toward an intake valve; and the penetration force of the integrated spray is suppressed before reaching the intake valve.

8. A fluid injection valve according to claim 2, wherein:

the fluid injection valve is mounted to an intake port so that a distal end portion of the fluid injection valve is oriented toward an intake valve; and a direction of orientation of the integrated spray is provided with a curvature to avoid direct collision of the integrated spray against a wall surface of the intake port.

9. A spray generator comprising the fluid injection valve according to claim 1.

10. A fluid injection valve according to claim 1, further comprising:

a cover plate, which is provided within the valve seat on an upstream of the injection-hole plate, the cover plate comprising:

a bottom portion disposed on the injection-hole plate and including a terminal end surface, and a thin portion disposed on the bottom portion and including a bottom side which is adjacent the terminal end surface; and a channel formed between the bottom side of the thin portion, the terminal end surface, and the injection-hole plate.

11. A fluid injection valve according to claim 1, wherein, at the downstream position of the switching spray, the direction of the long axis and the direction of the short axis of the cross section of the switching spray change such that the long axis is disposed toward the coalesced single sprays of the coalescent-spray injection holes.

12. A fluid injection valve according to claim 10, further comprising:

a shoulder which is formed on the injection-hole plate and disposed between an inlet of a corresponding injection hole, among the plurality of injection holes, and the terminal end surface, wherein a portion of the fluid in the fluid passage travels via the channel directly into the corresponding injection hole on a side distal to the terminal end surface and a portion of the fluid travels along the channel to the terminal end surface and is directed back by the terminal end surface along the shoulder as a back-flow and into an inner surface of the corresponding injection hole on a side proximate the terminal end surface.

* * * * *